US005120071A

United States Patent [19]

Thibault et al.

[11] Patent Number: 5,120,071

[45] Date of Patent: Jun. 9, 1992

[54] ADIRONDACK CHAIR FOR ELDERLY PEOPLE

[75] Inventors: Jane M. Thibault; Pat M. Kelly, both of Louisville, Ky.; Jeffrey B. Hunt, Borden, Ind.

[73] Assignee: Eld-Arondak, Inc., Borden, Ind.

[21] Appl. No.: 668,017

[22] Filed: Mar. 12, 1991

[51] Int. Cl.[5] ..... A61G 5/00

[52] U.S. Cl. ..... 280/474; 297/430; 297/DIG. 4; D6/370

[58] Field of Search ..... D6/361, 367, 370, 379, D6/380; 297/421, 430, 432, 445, DIG. 4; 280/650, 47.38, 47.4, 647

[56] References Cited

U.S. PATENT DOCUMENTS

| | | | |
|---|---|---|---|
| D. 68,027 | 8/1925 | Wurdack | D6/370 |
| D. 109,239 | 4/1938 | Wolpin | D6/370 |
| D. 163,297 | 5/1951 | Laskowitz . | |
| 235,437 | 12/1880 | Hopkins . | |
| D. 276,106 | 10/1984 | Grosfillex | D6/370 X |
| D. 294,890 | 3/1988 | Hubert . | |
| D. 305,081 | 12/1989 | Grosfillex . | |
| 333,659 | 1/1886 | Munshower . | |
| 376,256 | 1/1888 | Parks . | |
| 519,443 | 5/1894 | Chichester | 280/47.38 |
| 845,222 | 2/1907 | David . | |
| 1,591,529 | 7/1926 | Guerber | 280/47.4 |
| 2,006,667 | 7/1935 | Brown . | |
| 2,024,170 | 12/1935 | Kruse . | |
| 3,278,225 | 10/1966 | Stine . | |
| 3,902,758 | 9/1975 | Pivacek | 297/DIG. 4 X |
| 4,125,269 | 11/1978 | Kiel | 280/30 |

*Primary Examiner*—Andres Kashnikow
*Assistant Examiner*—Michael Mar
*Attorney, Agent, or Firm*—Fleit, Jacobson, Cohn, Price, Holman & Stern

[57] ABSTRACT

An Adirondack-type chair for therapeutic use with frail, older adults having a back support including six slats in a curved plane to support the lateral block muscles of the user on two medial slats and allowing the fragile spine of the user to be free from pressure which would be encountered by a central slat of a five-slat configuration. The curved plane of the back support follows the natural curvature of the trunk of the body to provide equal distribution of pressure along the back. Wheels are provided at the bottom of the chair for user mobility. A handle located at the top of the back support provides a grasp for both hands of an assistant pushing the chair. In addition, a footrest located above the rear wheels of the chair allows for downward pressure to be exerted by a foot of the assistant, while pulling rearwardly by the handles at the top of the chair, to elevate the front end of the chair. The chair is tilted rearwardly for easy movement over door sills and other obstacles. A rearmost edge of the bottom frame portion of the chair is spaced so as to provide a stop against over-inclination of the chair. The chair is thereby permitted to tilt to a safe angle (preferably a maximum of approximately 30°) so as to maintain the stability of the chair and the safety of its occupant.

13 Claims, 2 Drawing Sheets

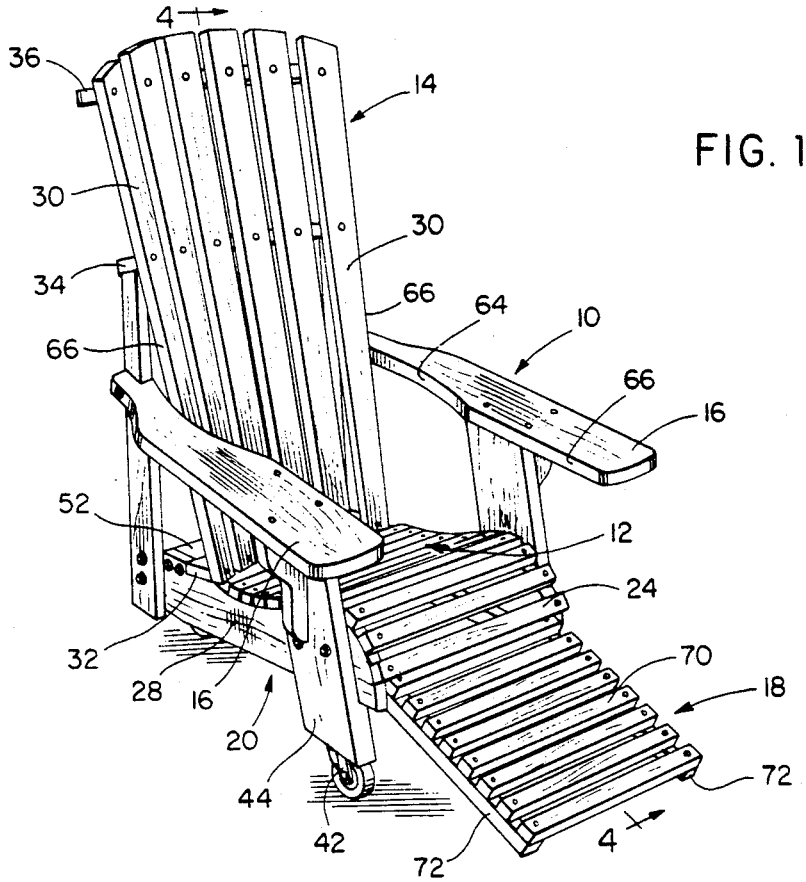
FIG. 1
FIG. 2
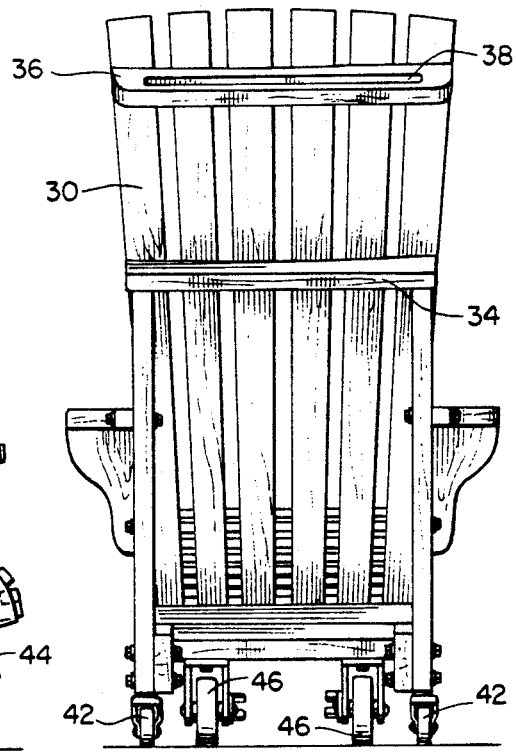
FIG. 3
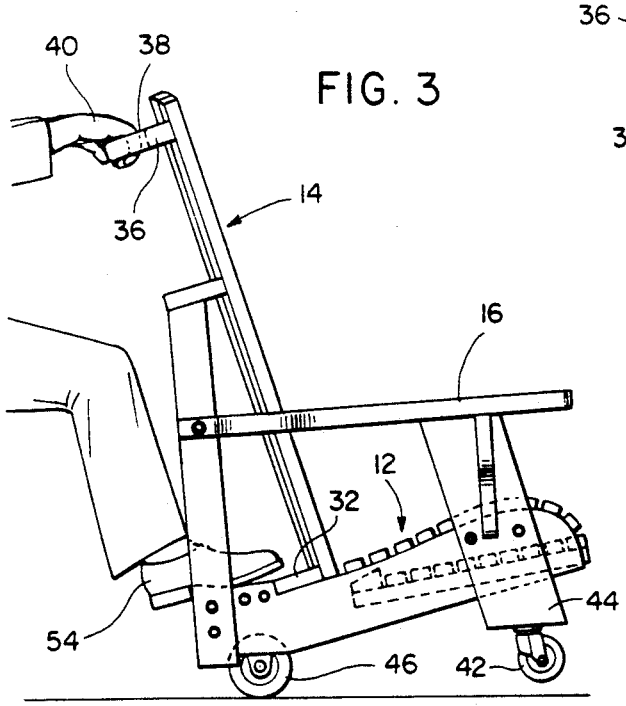

ADIRONDACK CHAIR FOR ELDERLY PEOPLE

FIELD OF THE INVENTION

This invention relates to the field of Adirondack chairs, and particularly, an Adirondack chair suitable for use by elderly people.

BACKGROUND OF THE INVENTION

Adirondack chairs have been available for many years to provide outdoor seating suitable to withstand all types of weather conditions. Typically made of wood, Adirondack chairs usually include a plurality of slats attached to a frame to form the back support and seat. Both the back support and seat are usually of a flat configuration.

Some examples of known chairs are disclosed in U.S. Pat. No. 2,006,667 to Brown, U.S. Pat. No. 2,024,170 to Kruse, Design U.S. Pat. No. 305,081 to Grosfillex and Design U.S. Pat. No. 294,890 to Hubert. The chairs disclosed in these patents are concerned with use by the general population. Their construction and dimensioning facilitate their use by healthy, mobile individuals.

SUMMARY OF THE INVENTION

It is an object of the present invention to provide an Adirondack-type chair which includes special features designed for therapeutic use with frail elderly.

This chair is therapeutic in that it enhances the mobility of frail, elderly users who are at high risk of injury due to falls out of chairs. Frail elderly who often experience poor balance and impaired judgment frequently have difficulty sitting for long periods and moving from one place to another. Chairs commonly used with the elderly, such as wheelchairs and Geri-chairs, protect the user at the cost of mobility. Also, they fail to provide proper support for the maintenance of body alignment, making the user more prone to foot drop and knee flexion contractures which permanently impair mobility.

Traditionally, Adirondack-type chairs have five-slats extending across the back support of the chair in a flat plane. In the chair of the present invention, the back support includes six slats in a curved plane to support the lateral back muscles of the user on two medial slats and allowing the fragile spine of the user to be free from pressure which would be encountered by a central slat of a five-slat configuration. The curved plane of the back support follows the natural curvature of the trunk of the body to provide equal distribution of pressure along the back.

Wheels are provided at the bottom of the chair for user mobility. Three-inch wheels at the front of the chair provide pivotal movement for directional steering while five-inch rear wheels, located at the rear of the chair, include a locking mechanism for fixing the location of the chair. An overall height of the chair has been reduced to allow for the addition of wheels at the bottom of the chair while maintaining a constant seat height over known Adirondack-type chairs.

Advantageously, a handle located at the top of the back support provides a grasp for both hands of an assistant pushing the chair. In addition, a footrest located above the rear wheels of the chair allows for downward pressure to be exerted by a foot of the assistant, while pulling rearwardly by the handles at the top of the chair, to elevate the front end of the chair. The chair is tilted rearwardly for easy movement over door sills and other obstacles. A rearmost edge of the bottom frame portion of the chair is spaced so as to provide a stop against over-inclination of the chair. The chair is thereby permitted to tilt to a safe angle (preferably a maximum of approximately 30°) so as to maintain the stability of the chair and the safety of its occupant.

The width of the chair has been reduced to a sixteen-inch width seat. This feature provides a more comfortable resting position for the arms of the occupant on the armrests by keeping the shoulders in proper body alignment. Further, the width allows easy entry of the hips past an indented portion of the armrests and into the chair, but once the user is actually seated, the muscles and adipose tissue can expand laterally to their natural shape and be securely supported by the seat of the chair. In addition, the backward slant of the seat of the chair allows the elderly user's own bodily center of gravity to prevent sliding and falling out, thus increasing safety.

The base of the chair has been modified to house a pull-out footrest that can be used for the user to elevate both legs in a comfortable fashion. The footrest is retractable into the base of the chair frame when not in use.

It is therefore another object of the present invention to provide an Adirondack-type chair for use with elderly people having a curved back support with support on opposite sides of the spine of the user and being moveable by wheels and tiltable rearwardly to a predetermined angle.

It is yet another object of the present invention to provide an Adirondack-type chair for use with elderly people having a curved back support with support on opposite sides of the spine of the user and being moveable by wheels and tiltable rearwardly to a predetermined angle with the tilting of the chair being accomplished by grasping an upper portion of the back support with two hands, placing a foot on a rest above rear wheels and pulling rearwardly on the upper portion of the back support.

It is yet another object of the present invention to provide an Adirondack-type chair for use with elderly people having a curved back support with support on opposite sides of the spine of the user and being moveable by wheels and having a retractable footrest and being tiltable rearwardly to a predetermined angle with the tilting of the chair being accomplished by grasping an upper portion of the chair with two hands, placing a foot on a rest above rear wheels and pulling rearwardly on the upper portion of the back support.

It is still yet another object of the present invention to provide an Adirondack-type chair for use with elderly people having a curved back support with support on opposite sides of the spine of the user and being moveable by wheels and having a retractable footrest and being tiltable rearwardly to a predetermined angle with the tilting of the chair being accomplished by grasping an upper portion of the chair with two hands, placing a foot on a rest above rear wheels and pulling rearwardly on the upper portion of the back support with front swivable wheels and dimensioned spacing between armrests to support the arms of the user on the armrests with the shoulders in proper body alignment when seated in the chair.

These and other objects of the invention, as well as many of the intended advantages thereof, will become more readily apparent when reference is made to the following description taken in conjunction with the accompanying drawings.

BRIEF DESCRIPTION OF THE DRAWINGS

FIG. 1 is a perspective view of a chair.

FIG. 2 is a rear view of the chair.

FIG. 3 is a side view of the chair.

DETAILED DESCRIPTION OF THE PREFERRED EMBODIMENTS

Figure 4:
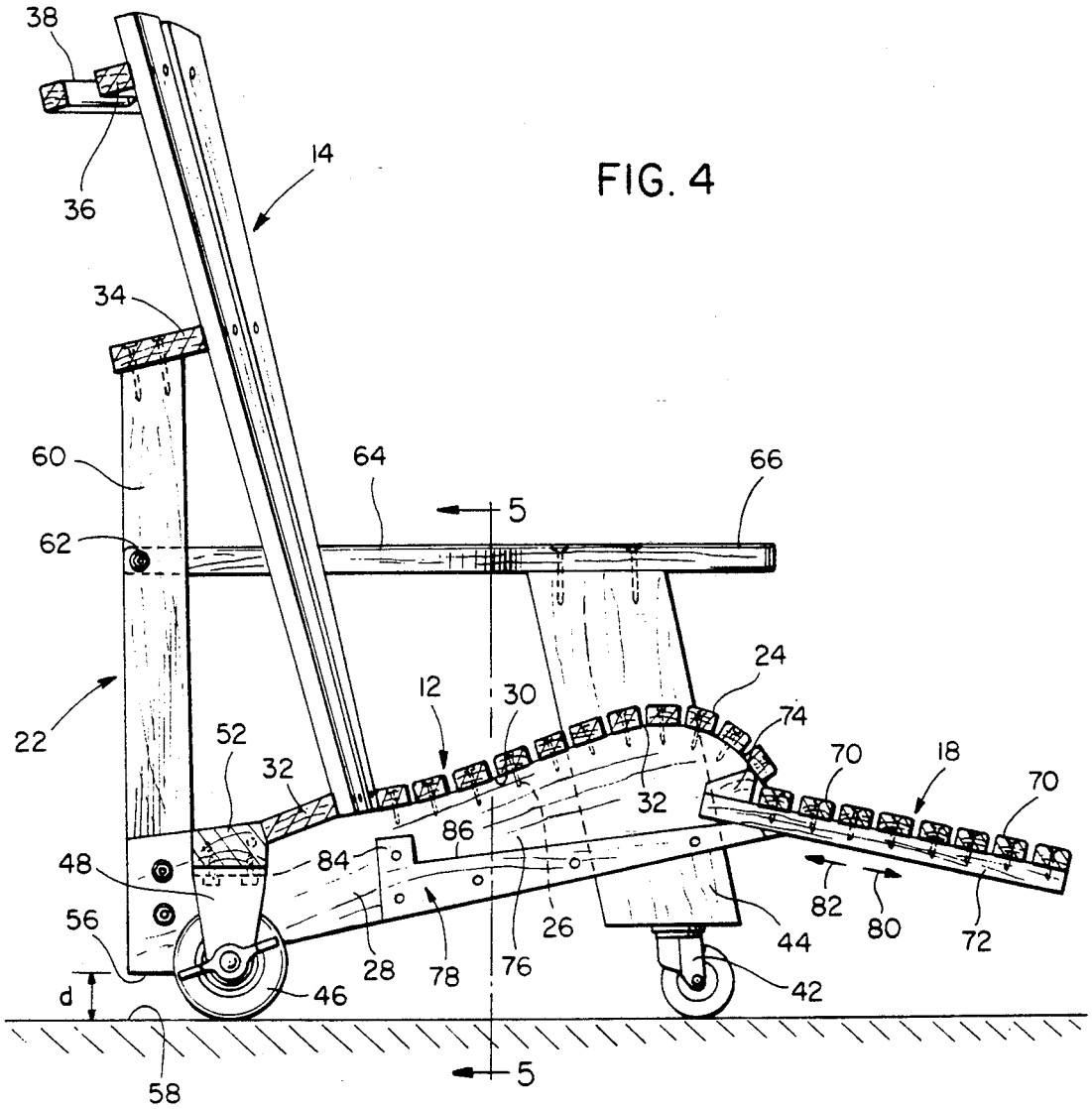
FIG. 4 is a longitudinal section taken along line 4—4 of FIG. 1.
Figure 5:
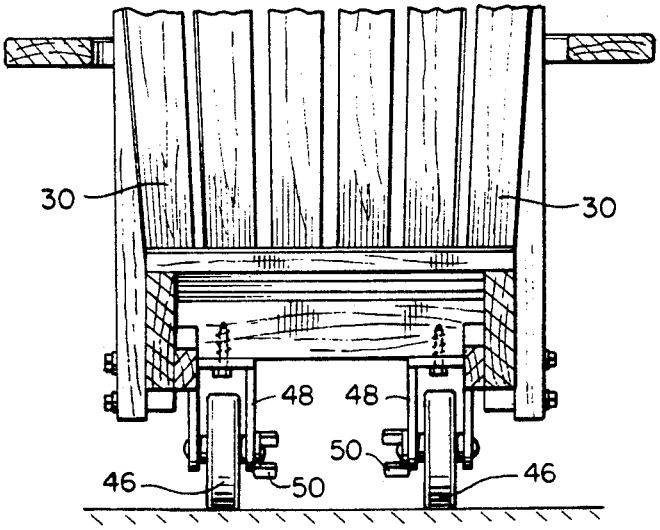
FIG. 5 is a cross-section taken along line 5—5 of FIG. 4.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

With reference to the drawings, in general, and to FIGS. 1 through 3, in particular, an Adirondack-type chair for use by elderly people embodying the teachings of the subject invention is generally designated as 10. With reference to its orientation in FIG. 1, the chair 10 comprises a seat 12, a back support 14, armrests 16, and footrest 18. The chair 10 also includes a seat support frame 20 and back support frame 22.

The seat 12 is formed of a plurality of horizontally-extending slats 24 secured by nails or screws 26 to the seat support frame 20. The support frame 20 includes two planks 28 having a sinusoidal configured upper edge 30 so that the slats 24 follow the configuration of the planks 28 and provide a curved seating area for a user. The highest point 32 of the upper edge 30 of the plank 28 provides support for the bottom of the legs of the user at approximately the knee area. This aids in maintaining the comfort of the user.

The back support 14 is made up of a plurality of vertically-extending slats 30. The number of slats used is preferably six in number, symmetrically spread out across back support frame 22 as shown in FIGS. 1 and 4. The slats 30 are secured to a lower support plank 32 by nails or screws and an intermediate support plank 34 by nails or screws. An upper support plank 36 to which the slats 30 are secured by nails or screws, includes an elongated opening 38 through which the hands 40 of an assistant may be placed to push the chair 10.

Movement of the chair is accomplished by the front wheels 42 which are pivotally mounted at a bottom of a chair arm support 44. The wheels 42 are pivotally mounted for directional guidance of the chair when pushed from the rear of the chair. At the rear of the chair are five-inch diameter rear wheels 46 which are mounted within U-shaped brackets 48 in a fixed orientation. Rear wheels 46 include a brake mechanism 50 for locking the position of the rear wheels to prevent undesired movement of the chair when the rear wheels are locked.

The brackets 48 are secured to a plank 52 which is aligned parallel to and adjacent to plank 32. Planks 32 and 52 provide a footrest for a foot 54 of an assistant so as to elevate the front wheels 42 of the chair to ride over a doorsill or other obstacle. The raising of the front end of the chair is accomplished by placing a foot on the planks 32. 52 and pulling downwardly by the hands 40 positioned through opening 38.

A predetermined distance "d" separating the lowermost and rearmost edge 56 of the rear support frame 22 from the floor 58 is provided to prevent an excessive amount of rearward tipping of the chair by the elevation of the front end of the chair and wheels 42. When the edge 56 contacts the floor 58, the chair will be elevated to an approximate angle of 30° and further elevation of the chair will be prevented. This limited amount of tilting of the chair provides for a safe transport of the user of the chair by an assistant.

An additional feature of the present invention is providing a predeterminate spacing between the arms 16 of the chair as supported by planks 44. The armrests 16 are secured to a vertically-extending post 60 by bolt 62. The armrests are spaced such that when a user sits on the seat 12, the arms resting on the armrest 16 will position the arms of the user in alignment with their shoulders. This is accomplished by the inwardly tapering curved portions 64 of the armrests 16. The tapered portions 64 extend from an outermost edge 66 of the back support 14 to an elongated portion 66 of the armrests 16 and extend inwardly towards the center of the chair from the plane of the outer edges 66 of the back support 14.

The chair 10 further includes a footrest formed of a plurality of slats 70 interconnecting two strips 72 by nails or screws. At one end of the strip 72 is a stop 74 which prevents complete pulling out of the footrest 18 from a space 76 located between the seat 12 and a slide guide 78. Upon movement in the direction of arrow 80, the footrest 18 is locked in engagement by contact of stop 74 against a slat 24. Similarly, when retracting the footrest by movement of the footrest in the direction of arrow 82, the stop 74 engages against an L-shaped projection 84 so that the strips 72 rest upon upper edge 86 of slide guide 78 in the cavity 76.

Therefore, by the present invention, an Adirondack-type chair has been modified to include many features desirable for a secure and safe relaxation of elderly people. The chair has been designed to incorporate specific features which advantageously work in combination to provide a mobile, tiltable and back supportive chair.

Having described the invention, many modifications thereto will become apparent to those skilled in the art to which it pertains without deviation from the spirit of the invention as defined by the scope of the appended claims.

We claim:

1. An Adirondack-type chair for use by elderly people, said chair comprising:

a frame including a seat and a back support, said back support being curved to support the back of an elderly person and including an even number of vertically extending spaced apart slats so as to define an opening between adjacent slats along a central longitudinal axis of said back support, said slats extending from said seat to an uppermost edge of said back support, and said seat being supported by two spaced, vertically extending planks, front wheel means mounted at a front end of said frame and rear wheel means mounted at a rear end of said frame for movement of the frame, said rear wheel means being located between said two planks and said two planks extending below at least a portion of said rear wheel means, a hand grip mounted adjacent to said uppermost edge said back support, and a footrest mounted rearwardly of a lower portion of said back support, above said rear wheel means, and extending substantially across a width of said frame for applying downward pressure on said rear wheel means by a foot of an assistant pushing the chair while the assistant simultaneously grips said hand grip and pulls rearwardly and downwardly on said hand grip to elevate said front wheel means.

2. A chair as claimed in claim 1, wherein stop means formed by said frame prevents excessive tilting of said frame during rearward and downward pulling of said hand grip by an assistant.

3. A chair as claimed in claim 2, wherein said stop means includes a lowermost edge of said frame spaced a predetermined distance above a floor.

4. A chair as claimed in claim 1, wherein said frame includes armrests spaced to support the arms of an elderly person resting on said armrests in alignment with their body.

5. A chair as claimed in claim 1, wherein six slats form said back support.

6. A chair as claimed in claim 1, wherein said seat is curved.

7. A chair as claimed in claim 1, wherein a footrest for an occupant of the chair is slidably mounted on the frame.

8. A chair as claimed in claim 1, wherein said rear wheel means are lockable.

9. An Adirondack-type chair for use by elderly people, said chair comprising:

a frame including a seat and a curved back support, said back support including an even number of vertically extending spaced apart slats so as to define an opening between adjacent slats along a central longitudinal axis of said back support, and said seat being supported by two spaced, vertically extending planks, front wheels mounted at a front end of said frame, rear wheels mounted at a rear end of said frame, said rear wheels being located between said two planks and said two planks extending below at least a portion of said rear wheels, a hand grip mounted at an upper portion of said back support, a footrest mounted rearwardly of a lower portion of said back support, above said rear wheel means, and extending substantially across a width of said frame for applying downward pressure on said rear wheels by a foot of an assistant pushing the chair while simultaneously gripping said hand grip and pulling rearwardly and downwardly on said hand grip to elevate said front wheel, and stop means defined by said frame for preventing excessive elevation of said front wheels during rearward and downward pulling of said hand grip by the assistant.

10. An Adirondack-type chair as claimed in claim 9, wherein said frame includes armrests spaced to support the arms of an elderly person resting on said armrests in alignment with their body.

11. An Adirondack-type chair as claimed in claim 9, wherein said back support includes six slats.

12. An Adirondack-type chair as claimed in claim 9, wherein said stop means includes a lowermost edge of said frame spaced a predetermined distance above a floor.

13. An Adirondack-type chair as claimed in claim 9, wherein a footrest for an occupant of the chair is slidably mounted on the frame.

* * * * *